US011534000B2

(12) United States Patent
Cook et al.

(10) Patent No.: US 11,534,000 B2
(45) Date of Patent: Dec. 27, 2022

(54) FOLDABLE CHAIR WITH SPRINGS

(71) Applicant: Westfield Outdoor, Inc., Indianapolis, IN (US)

(72) Inventors: Jordan Cook, Indianapolis, IN (US); Darin M. Webb, Carmel, IN (US)

(73) Assignee: Westfield Outdoor, Inc., Indianapolis, IN (US)

( * ) Notice: Subject to any disclaimer, the term of this patent is extended or adjusted under 35 U.S.C. 154(b) by 0 days.

(21) Appl. No.: 17/100,200

(22) Filed: Nov. 20, 2020

(65) Prior Publication Data

US 2021/0153657 A1 May 27, 2021

Related U.S. Application Data

(60) Provisional application No. 62/939,664, filed on Nov. 24, 2019.

(51) Int. Cl.

| | |
|---|---|
| ***A47C 4/28*** | (2006.01) |
| ***A47C 7/02*** | (2006.01) |
| ***A47C 7/00*** | (2006.01) |

(52) U.S. Cl.

CPC ..... *A47C 4/283* (2013.01); *A47C 7/002* (2013.01); *A47C 7/025* (2013.01)

(58) Field of Classification Search

CPC ..... A47C 3/02; A47C 3/0252; A47C 4/283; A47C 7/025; A47C 7/002; A47C 4/48; A47C 4/38

USPC ..... 297/45, 302.1, 302.6

See application file for complete search history.

(56) References Cited

U.S. PATENT DOCUMENTS

| | | | | | |
|---|---|---|---|---|---|
| 34,204 | A | * | 1/1862 | Goodwin | A47C 7/70 297/36 |
| 65,520 | A | * | 6/1867 | Whitmore | A47C 4/283 297/36 |
| 77,161 | A | | 4/1868 | Blake | |
| 89,827 | A | | 5/1869 | Badlam et al. | |
| 92,758 | A | | 7/1869 | Smith | |
| 114,812 | A | | 5/1871 | Hailman | |
| 165,684 | A | | 7/1875 | Ober | |
| 182,845 | A | * | 10/1876 | Mohr | A47C 3/027 297/268.1 |
| 326,165 | A | | 9/1885 | Short | |
| 369,806 | A | | 9/1887 | Nabal | |

(Continued)

FOREIGN PATENT DOCUMENTS

| | | |
|---|---|---|
| CN | 101410036 B | 3/2011 |
| DE | 1554179 A1 | 5/1970 |

(Continued)

OTHER PUBLICATIONS

Public Version of Initial Determination for ITC Investigation No. 337-TA-1178, Mar. 18, 2021, 320 pages.

(Continued)

*Primary Examiner* — Milton Nelson, Jr.

(74) *Attorney, Agent, or Firm* — Thompson Coburn LLP

(57) ABSTRACT

A foldable chair has frames connected to one another by cross supports, bases connected to the frames by base supports and frame supports, with springs secured between the base supports and frame supports to allow for back and forth movement of the frames when a user is seated in the chair. The foldable chair includes a pliant membrane providing a seating surface for supporting the user.

16 Claims, 18 Drawing Sheets

(56) References Cited

U.S. PATENT DOCUMENTS

| | | | | | |
|---|---|---|---|---|---|
| 413,273 | A | | 10/1889 | Brown | |
| 451,490 | A | | 5/1891 | Kade | |
| 490,366 | A | | 1/1893 | Seng | |
| 1,138,270 | A | | 5/1915 | Ziegler et al. | |
| 1,488,863 | A | * | 4/1924 | Caddell | A47C 3/0252 297/266.1 |
| 1,627,388 | A | | 5/1927 | Hayes | |
| 1,676,074 | A | | 7/1928 | Brown | |
| 1,856,759 | A | | 5/1932 | Grondin | |
| 1,875,034 | A | * | 8/1932 | Larsen | A47C 3/021 248/188.1 |
| 1,882,585 | A | | 10/1932 | Hayes | |
| 1,925,246 | A | | 9/1933 | Hayes | |
| 2,056,957 | A | | 10/1936 | Colbridge | |
| 2,064,137 | A | * | 12/1936 | Zerbee | A47C 3/021 297/290 |
| 2,106,066 | A | * | 1/1938 | Sadgrove | A47C 7/287 248/629 |
| 2,537,071 | A | * | 1/1951 | Lukins | A47C 3/0252 297/294 |
| 2,543,543 | A | | 2/1951 | Gomes et al. | |
| 2,611,419 | A | | 9/1952 | McKinney | |
| 2,620,859 | A | * | 12/1952 | Kundtz | A47C 3/029 297/45 |
| 2,646,838 | A | | 7/1953 | Welsh | |
| 2,675,057 | A | | 4/1954 | Glass | |
| 2,758,634 | A | | 8/1956 | Welsh et al. | |
| 2,818,910 | A | * | 1/1958 | Hawkins | A61G 5/10 297/45 |
| 2,837,142 | A | | 6/1958 | McGuire | |
| 2,930,429 | A | | 3/1960 | Mize | |
| 3,114,572 | A | | 12/1963 | Hopkins | |
| 3,337,265 | A | | 8/1967 | Benzing | |
| 3,414,325 | A | | 12/1968 | Jutila | |
| 3,730,584 | A | | 5/1973 | Uchida | |
| 3,968,991 | A | | 7/1976 | Maclaren | |
| 4,082,348 | A | | 4/1978 | Haury | |
| 4,101,143 | A | | 7/1978 | Sieber | |
| 4,105,244 | A | | 8/1978 | Colby | |
| 4,119,343 | A | | 10/1978 | Pentzien | |
| 4,140,341 | A | | 2/1979 | Rabe | |
| 4,141,530 | A | | 2/1979 | Ward | |
| 4,183,494 | A | | 1/1980 | Cleveland | |
| 4,232,897 | A | | 11/1980 | Maclaren et al. | |
| 4,285,543 | A | | 8/1981 | Clark | |
| 4,340,250 | A | * | 7/1982 | Ward | A47C 3/0252 248/629 |
| 4,453,732 | A | | 6/1984 | Assanah et al. | |
| 4,593,929 | A | | 6/1986 | Williams | |
| 4,674,795 | A | | 6/1987 | Nelson | |
| 4,684,149 | A | | 8/1987 | Meyer | |
| 4,685,725 | A | * | 8/1987 | Helfrich | A47C 4/286 297/440.11 |
| 4,736,984 | A | | 4/1988 | Tacker | |
| 4,754,987 | A | | 7/1988 | Williams | |
| 4,772,067 | A | | 9/1988 | Fowler | |
| 4,786,072 | A | | 11/1988 | Girvin | |
| 4,809,998 | A | | 3/1989 | Girvin | |
| 4,826,241 | A | | 5/1989 | Barras | |
| 4,979,779 | A | | 12/1990 | Williams | |
| 5,004,259 | A | | 4/1991 | Ayers et al. | |
| 5,040,846 | A | | 8/1991 | Finney et al. | |
| 5,076,390 | A | | 12/1991 | Haskins | |
| 5,188,383 | A | | 2/1993 | Thompson | |
| 5,328,183 | A | | 7/1994 | Counts | |
| 5,375,911 | A | | 12/1994 | Morrow | |
| 5,419,571 | A | | 5/1995 | Vaughan | |
| 5,507,548 | A | | 4/1996 | Marhefka | |
| 5,513,867 | A | | 5/1996 | Bloswick et al. | |
| 5,873,624 | A | | 2/1999 | Simpson | |
| 5,992,929 | A | | 11/1999 | Liu | |
| 6,082,813 | A | | 7/2000 | Chen | |
| 6,247,749 | B1 | | 6/2001 | Yu | |
| 6,398,297 | B1 | | 6/2002 | Cantwell | |
| 6,439,656 | B1 | | 8/2002 | Liu | |
| 6,547,206 | B1 | * | 4/2003 | Dickie | A61G 5/1081 248/575 |
| 6,634,705 | B1 | | 10/2003 | Zheng | |
| 6,682,135 | B2 | | 1/2004 | Zheng | |
| 6,736,450 | B2 | | 5/2004 | Miyagi | |
| 6,827,401 | B2 | | 12/2004 | Marshall et al. | |
| 6,839,918 | B1 | | 1/2005 | Jensen | |
| 6,926,356 | B2 | | 8/2005 | Chen | |
| 7,066,534 | B2 | | 6/2006 | Choi | |
| 7,077,422 | B2 | | 7/2006 | Haury et al. | |
| 7,100,975 | B1 | | 9/2006 | Zheng | |
| 7,322,650 | B2 | | 1/2008 | Chouinard et al. | |
| 7,384,058 | B2 | | 6/2008 | Munsey et al. | |
| 7,543,893 | B2 | | 6/2009 | LaPointe | |
| 7,669,881 | B2 | | 3/2010 | Haury et al. | |
| 7,841,660 | B2 | | 11/2010 | Wang et al. | |
| 7,918,495 | B2 | | 4/2011 | Chen | |
| 8,083,252 | B2 | | 12/2011 | Wagner et al. | |
| 8,100,469 | B2 | | 1/2012 | Lougee | |
| 8,251,442 | B2 | | 8/2012 | Grace | |
| 8,344,272 | B1 | * | 1/2013 | Goldberg | A47C 4/283 177/144 |
| 8,511,747 | B2 | * | 8/2013 | Lougee | A47C 9/105 297/16.2 |
| 8,814,261 | B2 | | 8/2014 | Chamberlain et al. | |
| 8,864,222 | B2 | | 10/2014 | Grace | |
| 9,060,611 | B2 | | 6/2015 | Grace | |
| 9,095,216 | B2 | | 8/2015 | Miller | |
| 9,492,339 | B2 | | 11/2016 | Leib | |
| 10,888,163 | B2 | | 1/2021 | Cook | |
| 2001/0028187 | A1 | | 10/2001 | Kielhorn | |
| 2003/0006578 | A1 | | 1/2003 | Melgarejo et al. | |
| 2005/0077760 | A1 | | 4/2005 | Smith | |
| 2010/0072790 | A1 | | 3/2010 | Pleiman et al. | |
| 2010/0171342 | A1 | | 7/2010 | Chen | |
| 2013/0106145 | A1 | | 5/2013 | Chen | |
| 2015/0082526 | A1 | | 3/2015 | Grudzinski | |
| 2016/0206101 | A1 | | 7/2016 | Grace | |
| 2020/0323344 | A1 | | 10/2020 | Zhu | |

FOREIGN PATENT DOCUMENTS

| | | | |
|---|---|---|---|
| DE | 29921829 | U1 | 2/2000 |
| EP | 2220966 | A1 | 8/2010 |
| GB | 158988 | A | 2/1921 |
| JP | 0723833 | A | 1/1995 |
| JP | H11318627 | A | 11/1999 |
| JP | 3079374 | B2 | 8/2000 |
| JP | 2001061597 | A | 3/2001 |
| TW | 293263 | | 12/1996 |
| WO | 0217750 | A1 | 3/2002 |
| WO | 2002098260 | A1 | 12/2002 |

OTHER PUBLICATIONS

Public Version of Commission Opinion for ITC Investigation No. 337-TA-1178, May 18, 2021, 43 pages.

Public Version of Respondent Westfield Outdoor, Inc.'s Motion for Summary Determination for ITC Investigation No. 337-TA-1178, Mar. 27, 2020, 540 pages.

* cited by examiner

FOLDABLE CHAIR WITH SPRINGS

CROSS-REFERENCE TO RELATED APPLICATIONS

This application claims the benefit of priority to U.S. provisional application Ser. No. 62/939,664, filed Nov. 24, 2019, entitled FOLDABLE CHAIR WITH SPRINGS, the entirety of which is incorporated herein by reference.

STATEMENT REGARDING FEDERALLY SPONSORED RESEARCH OR DEVELOPMENT

Not applicable.

APPENDIX

Not applicable.

BACKGROUND OF THE INVENTION

The present disclosure is directed to a foldable chair comprising a left frame, a right frame, a plurality of cross supports, a left base, a right base, a left spring, a right spring and a pliant membrane.

SUMMARY

The left spring comprises a left forward spring portion, a left rearward spring portion, and a left intermediate spring portion. The left intermediate spring portion is between the left forward and rearward spring portions and extends from the left forward spring portion to the left rearward spring portion. One of the left forward and rearward spring portions is fixedly secured to the left base and the other of the left forward and rearward spring portions is fixedly secured to the left frame.

The left spring is secured to the left base and the left frame in a manner such that the left intermediate spring portion is capable of deflecting relative to the left base and relative to the left frame to enable back and forth movement of the left frame relative to the left base between a left frame first position and a left frame second position.

The right spring comprises a right forward spring portion, a right rearward spring portion, and a right intermediate spring portion. The right intermediate spring portion is between the right forward and rearward spring portions and extends from the right forward spring portion to the right rearward spring portion. One of the right forward and rearward spring portions is fixedly secured to the right base, and the other of the right forward and rearward spring portions is fixedly secured to the right frame.

The right spring is secured to the right base and the right frame in a manner such that the right intermediate spring portion is capable of deflecting relative to the right base and relative to the right frame to enable back and forth movement of the right frame relative to the right base between a right frame first position and a right frame second position.

The plurality of cross supports is operatively pivotally connected to the left and right frames to enable movement of the left and right frames between an expanded position and a collapsed position. In the expanded position the left frame is spaced from the right frame at a first distance, and in the collapsed position the left frame is spaced from the right frame at a second distance, with the second distance being less than the first distance.

The pliant membrane is operatively connected to portions of the left and right frames such that in the expanded position the pliant membrane is configured to provide a seating surface for supporting a user.

The chair is configured such that a user seated on the seating surface with the left and right frames in the expanded position may move back and forth to move the left and right frames relative to the left and right bases between the left and right frame first and second positions.

Further features and advantages of the present chair, as well as the operation of such, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION

Figure 1:
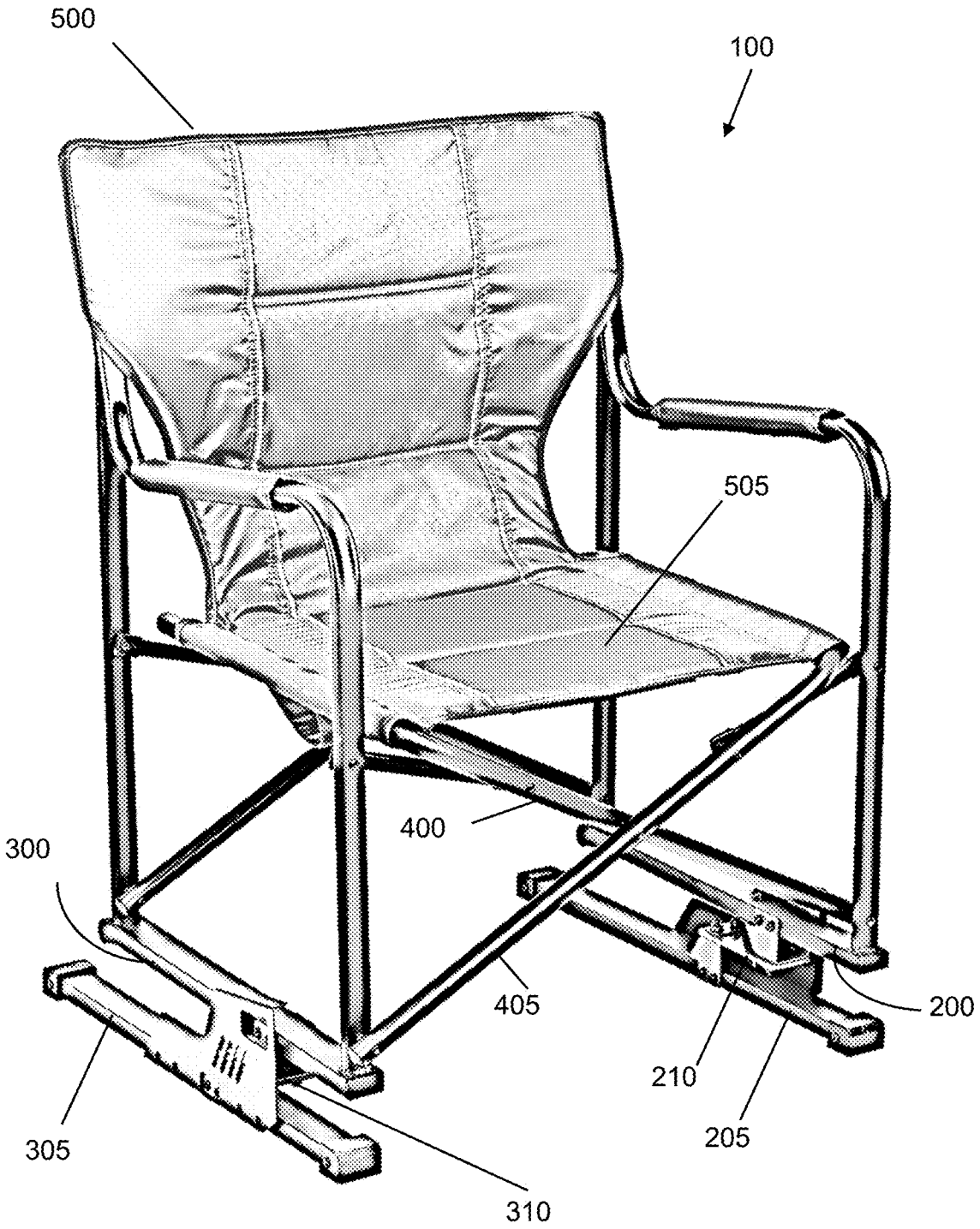
FIG. 1 is a perspective view of an exemplary foldable chair.

Referring to the accompanying drawings in which like reference numbers indicate like elements, FIG. 1 illustrates a preferred embodiment of the present foldable chair 100. The chair 100 comprises a left frame 200, a left base 205, a left spring 210, a right frame 300, a right base 305, a right spring 310, a plurality of cross supports 400 and 405, and a pliant membrane 500.

Figure 2:
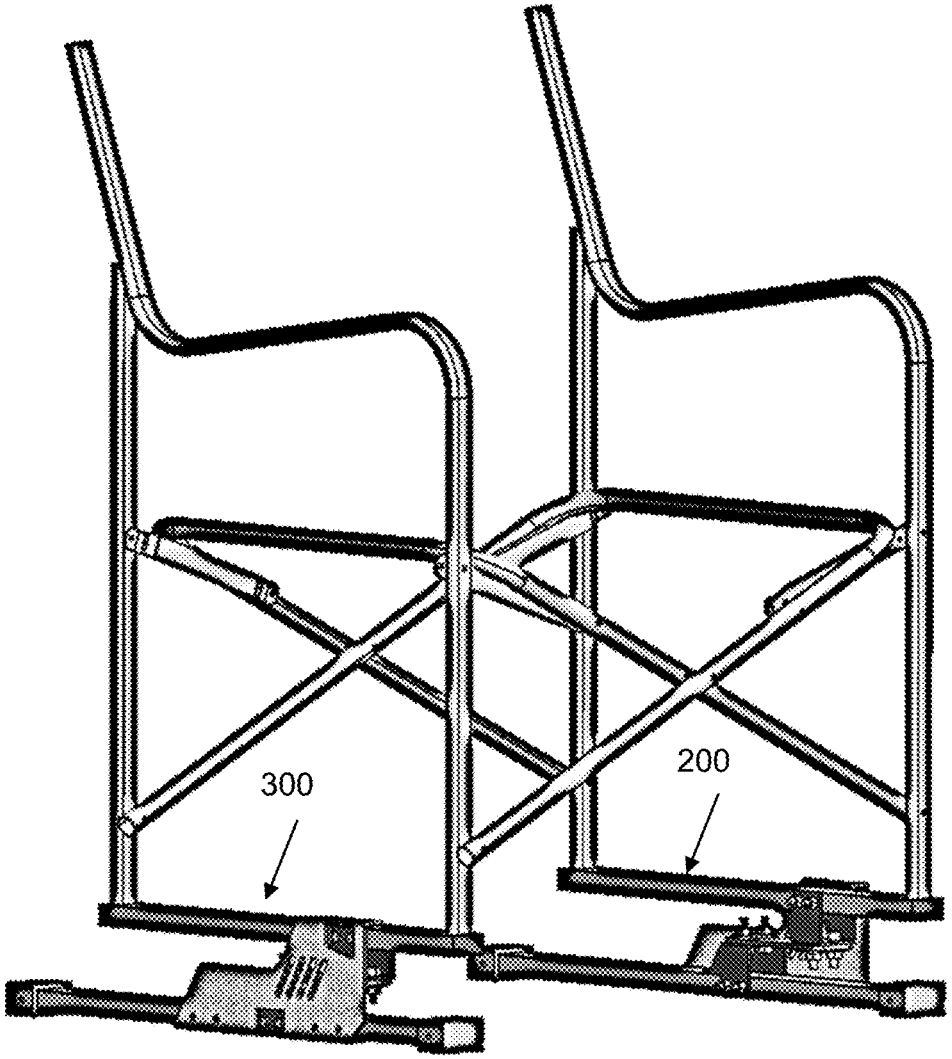
FIG. 2 is a perspective view of the foldable chair of FIG. 1 without a pliant membrane.

As shown in FIG. 2, the left frame 200 may comprise rails. These rails may be formed integrally as one piece, or as two pieces coupled together by any known technique such as welding or by fasteners. Like the left frame, the right frame 300 may comprise rails formed similarly to the rails of the left frame. The pliant membrane 500 may be attached to portions of the rails of the left and right frames 200, 300 and to portions of the cross supports 400 and 405 to form a seating surface 505 for supporting a user.

Figure 3:
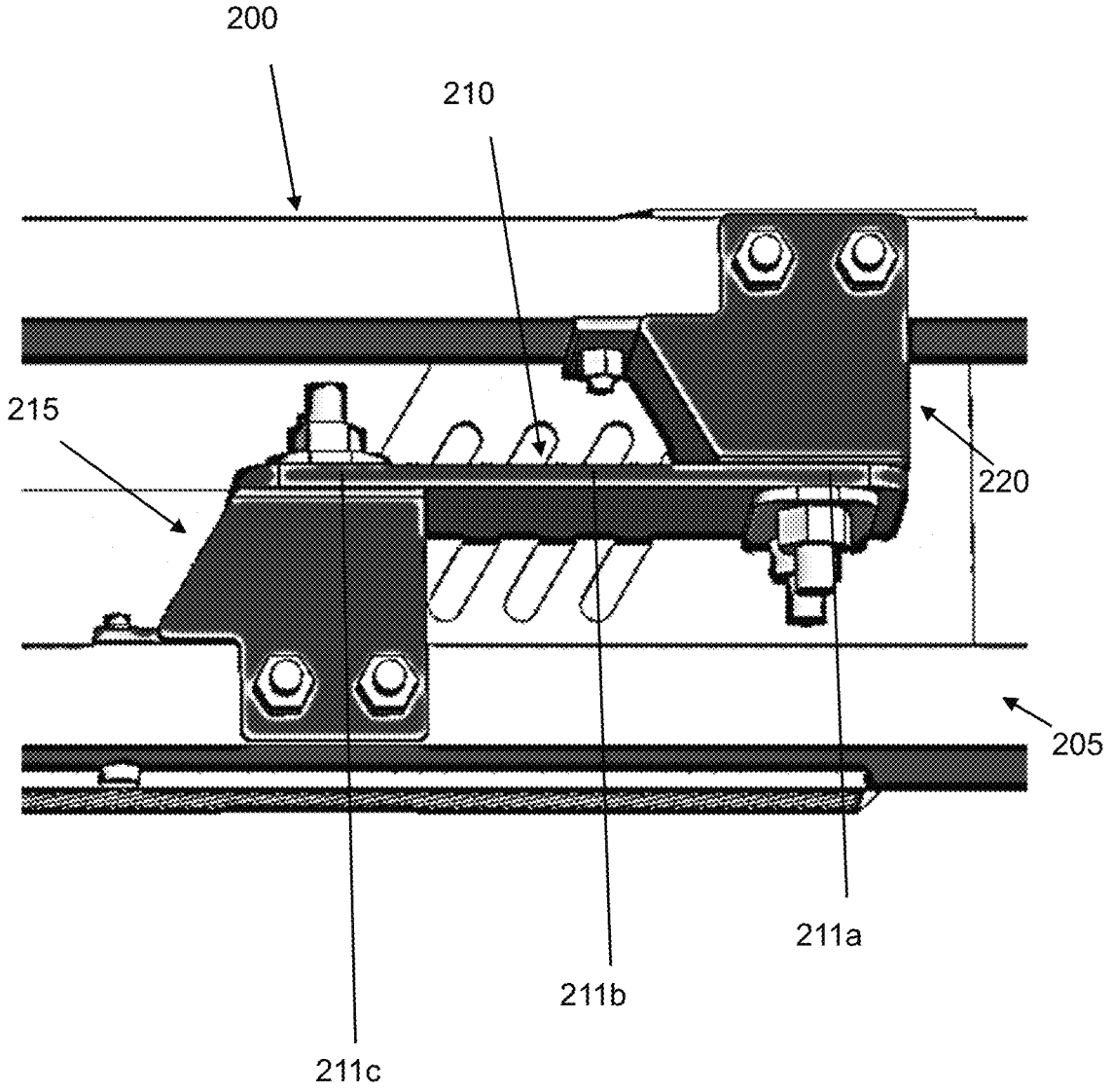
FIG. 3 is an enlarged fragmented side view of a left portion of the foldable chair showing a left spring of the foldable chair.

As shown in FIG. 3, the left spring 210 may comprise top and bottom surfaces, a left forward spring portion 211*a*, a left intermediate spring portion 211*b*, and a left rearward spring portion 211*c*, with the left intermediate spring portion 211*b* being between the left forward and rearward spring portions 211*a*, 211*c*, and extending from the left forward spring portion 211*a* to the left rearward spring portion 211*c*. The left base 205 may comprise a left base support 215, and the left frame 200 may comprise a left frame support 220. The left base support 215 may be integrally formed with the other portions of left base 205 or may be a separate piece fixedly secured to the other portions. The left frame support 220 may be integrally formed with the other portions of the left frame 200 or may be a separate piece fixedly secured to the other portions. The left forward spring portion 211*a* is fixedly secured to the left frame support 220 of the left frame 200 with fasteners such as nuts and bolts, screws, etc. For example, the left frame 200 can be formed with through-holes for receiving a post of a bolt, and the left forward spring portion 211*a* and the left frame support 220 can be formed with aligning holes that accept a fastener such as a bolt. The left rearward spring portion 211*c* can be fixedly secured to the left base support 215 of the left base 205 as described above with respect to the left forward spring portion 211*a* and left frame support 220.

Figure 4:
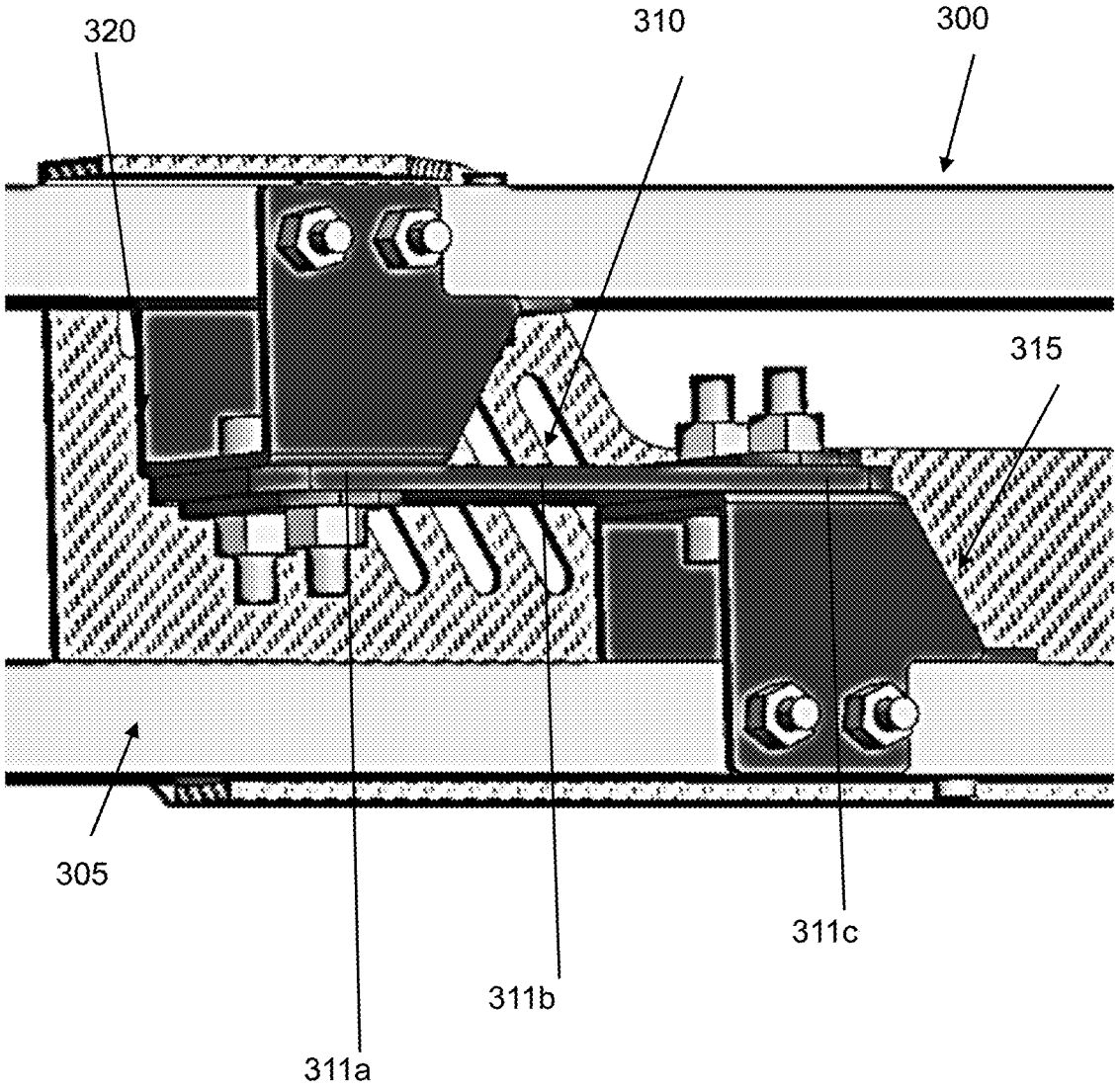
FIG. 4 is an enlarged fragmented view of a right portion of the foldable chair showing a right spring of the foldable chair.

As shown in FIG. 4, the right spring 310 may comprise top and bottom surfaces, a right forward spring portion 311*a*, a right intermediate spring portion 311*b*, and a right rearward spring portion 311*c*, with the right intermediate spring portion 311*b* being between the right forward and rearward spring portions 311*a*, 311*c*, and extending from the right forward spring portion 311*a* to the right rearward spring portion 311*c*. The right base 305 may comprise a right base support 315, and the right frame 300 may comprise a right frame support 320. The right base support may be integrally formed with the other portions of right base or may be a separate piece fixedly secured to the other portions. The right frame support may be integrally formed with the other portions of the right frame or may be a separate piece fixedly secured to the other portions. The right forward spring portion 311*a* can be fixedly secured to the right frame support 320 of the right frame 300 with fasteners such as nuts and bolts, screws, etc. For example, the right frame 300 can be formed with through-holes for receiving a post of a bolt, and the right forward spring portion 311*a* and the right frame support 320 can be formed with aligning holes that accept a fastener such as a bolt. The right rearward spring portion 311*c* can be fixedly secured to the right base support 315 of the right base 305 as described above with respect to the right forward spring portion 311*a* and right frame support 320.

Figure 5:
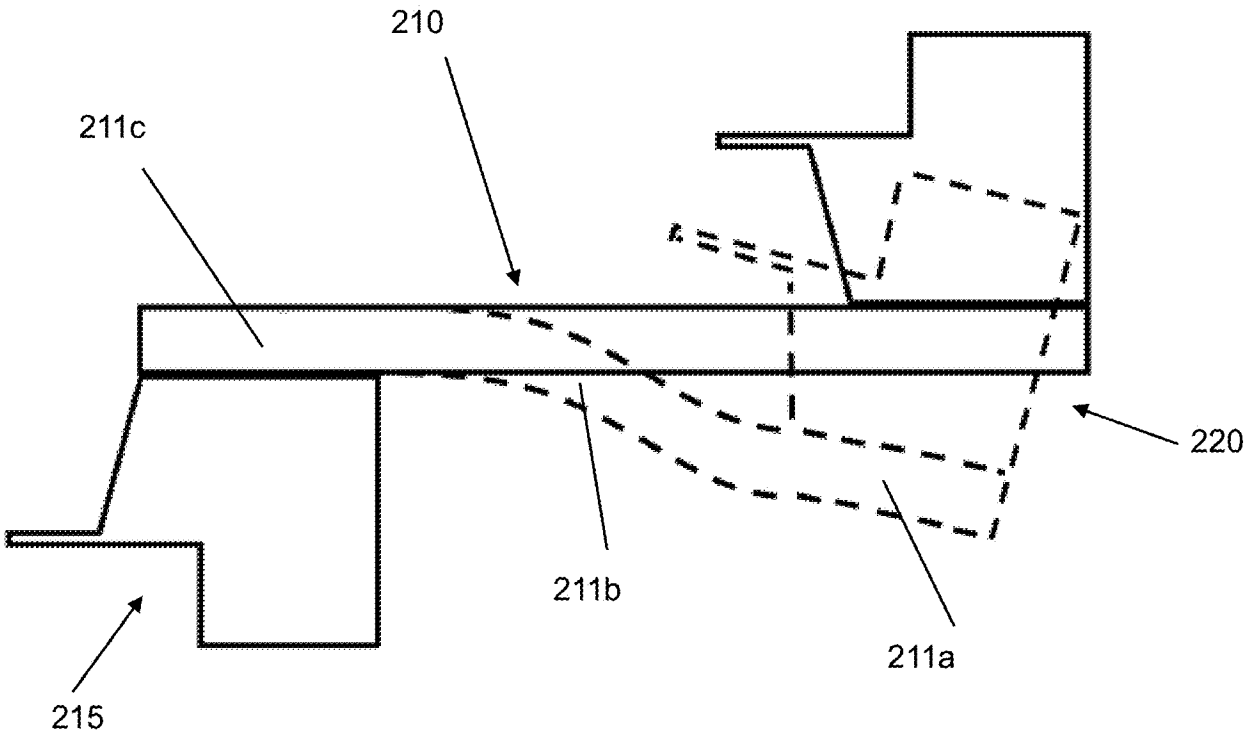
FIG. 5 is a schematic side elevation of the left spring in a first deflected position.
Figure 6:
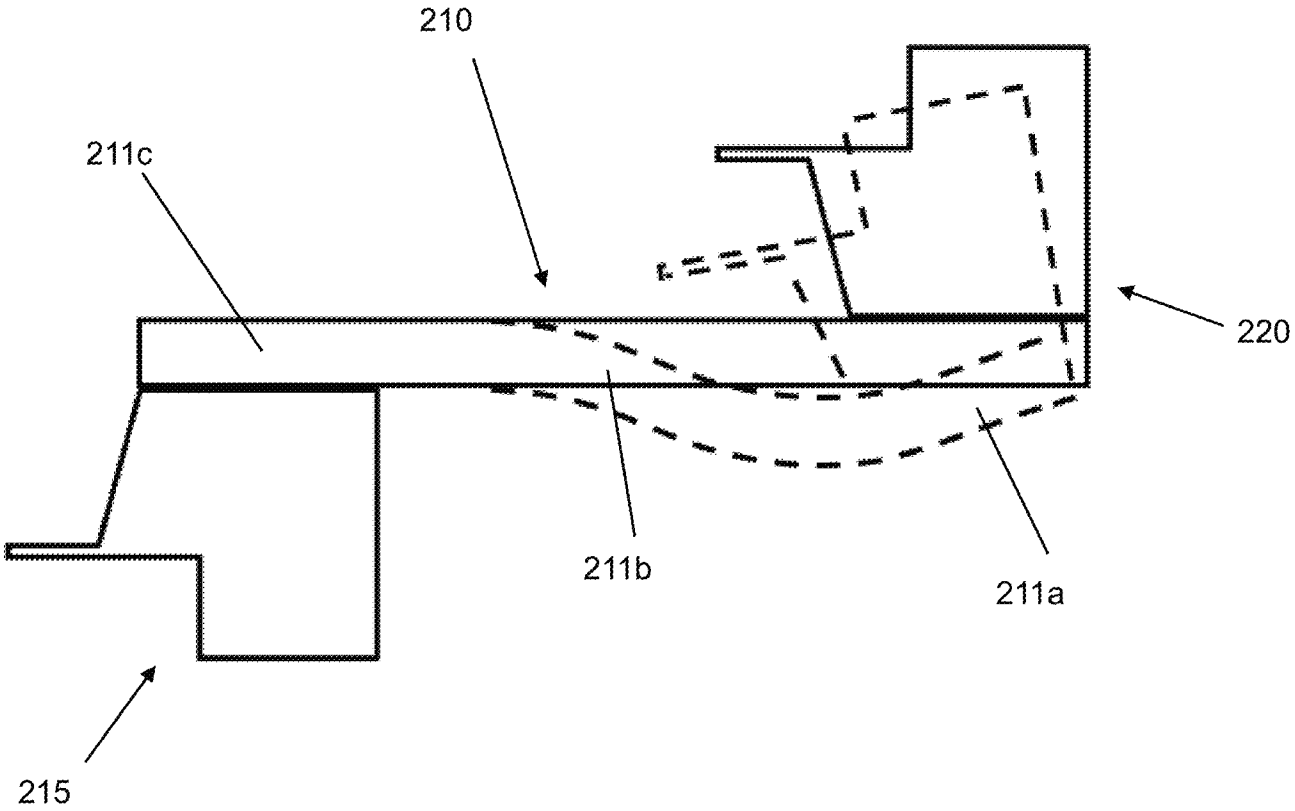
FIG. 6 is a schematic side elevation of the left spring in a second deflected position.

FIGS. 5 and 6 illustrate the manner in which the intermediate portions of the springs resiliently bend (or deflect) back and forth when a user sits in the chair 100 and moves from a first (e.g., forward) position (FIG. 5) to a second (e.g., rearward) position (FIG. 6). The left spring 210 is secured to the left frame 200 and the left base 205 in a manner such that the left intermediate spring portion 211*b* is capable of deflecting relative to the left base 205 and relative to the left frame 200 to enable back and forth movement of the left frame 200 relative to the left base 205 between a left frame first position shown in FIG. 5 and a left frame second position shown in FIG. 6. The right spring 310 is secured to the right frame 300 and the right base 305 in a manner such that the right intermediate spring portion 311*b* is capable of deflecting relative to the right base 305 and relative to the right frame 300 to enable back and forth movement of the right frame 300 relative to the right base 305 between a right frame first position and a right frame second position, in the manner described above with respect to the left spring 210. Each of the right and left springs may constitute a plate or a bar. The springs may be cantilever springs.

Figure 9:
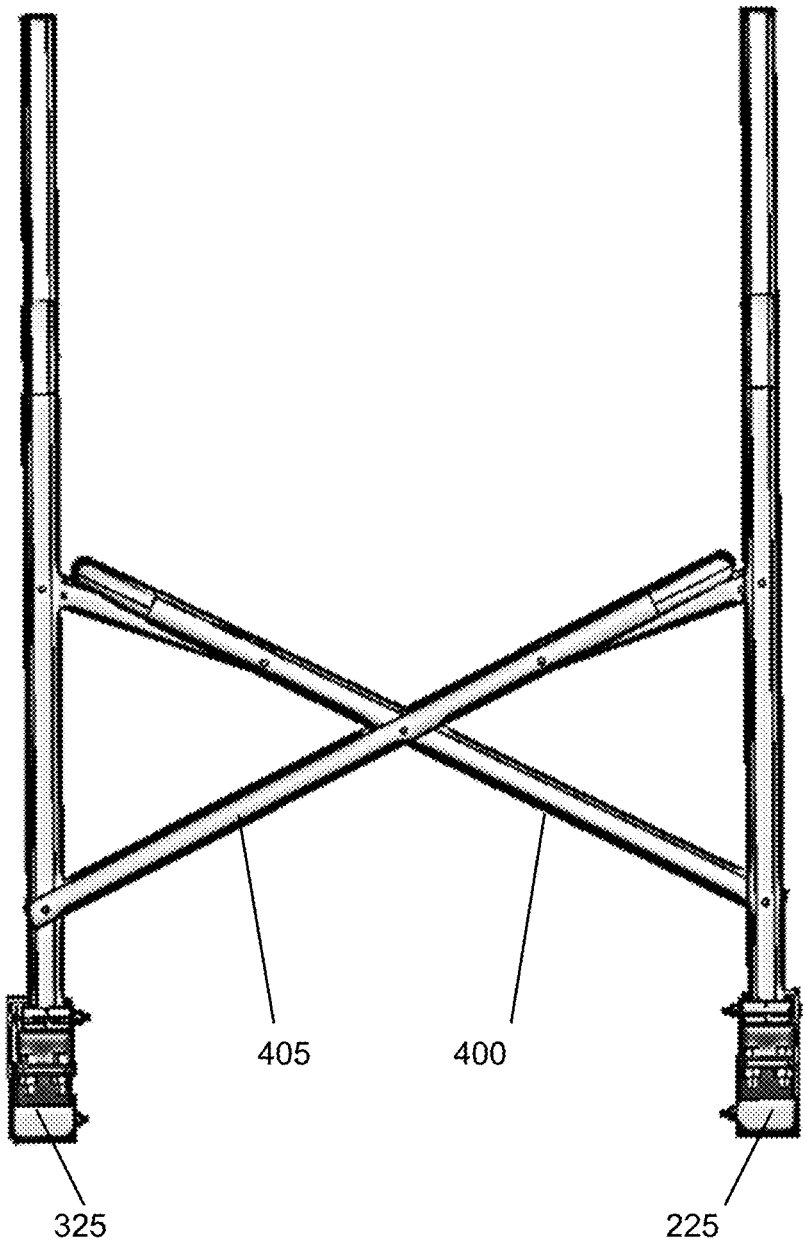
FIG. 9 is a front view of the foldable chair of FIG. 1 without the pliant membrane.
Figure 10:
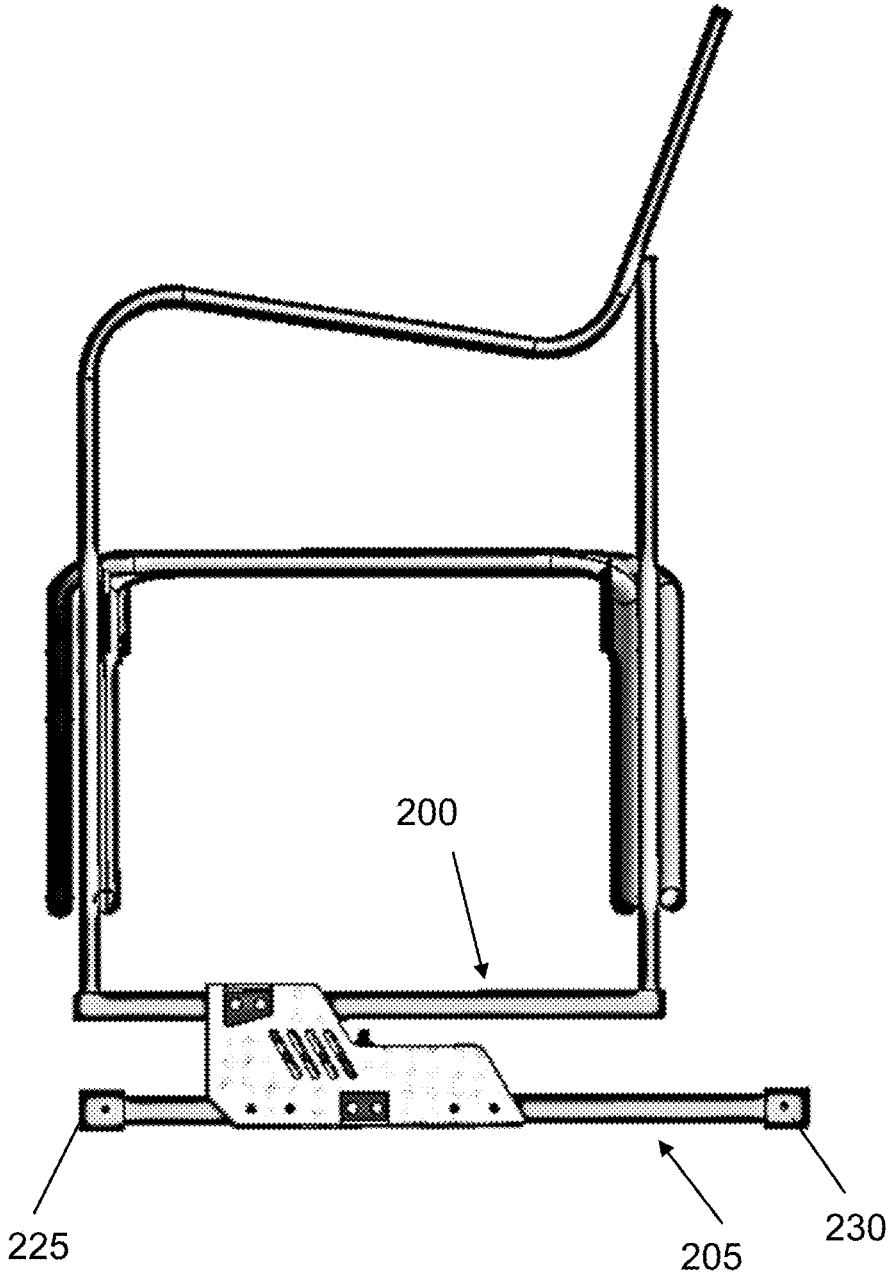
FIG. 10 is a right side view of the foldable chair of FIG. 1 without the pliant membrane.
Figure 11:
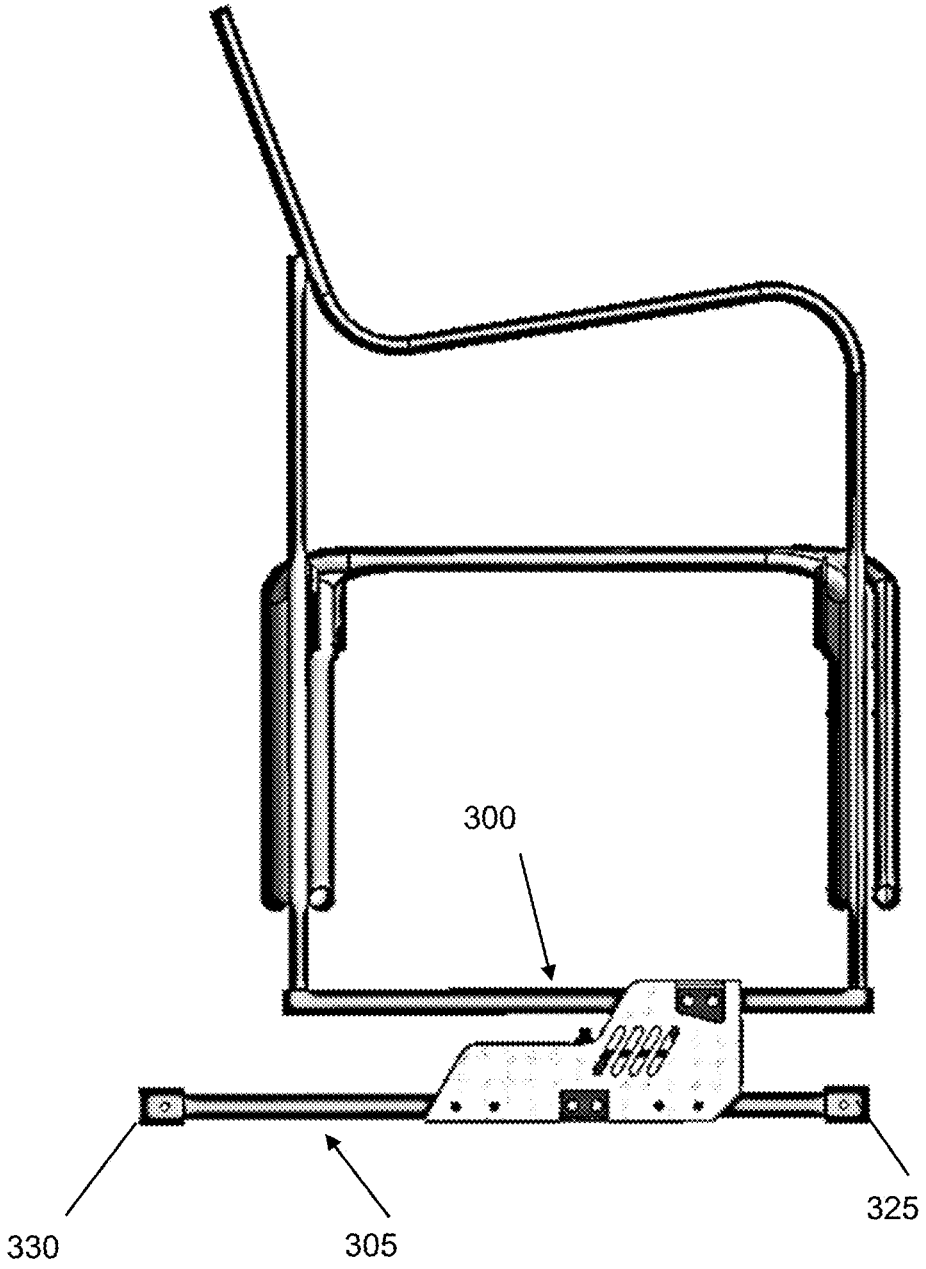
FIG. 11 is a left side view of the foldable chair of FIG. 1 without the pliant membrane.

As shown in FIGS. 9-11, the left base 205 comprises a left front ground support 225 and a left rear ground support 230, and the right base 305 comprises a right front ground support 325 and a right rear ground support 330. The ground supports may each comprise a footing with a texturized surface (e.g., grip) or material (e.g., rubber) to prevent the chair from sliding on a support surface on which the chair is positioned, for example. These ground supports may comprise an endcap that encompasses a portion of the ends of the base therein and be fastened or otherwise fixed to the base (e.g., with adhesive).

The left spring 210 may be fixedly secured to a forward portion of the left base 205 and fixedly secured to a forward portion of the left frame 200, and the right spring 310 may be fixedly secured to a forward portion of the right base 305 and fixedly secured to a forward portion of the right frame 300, such that when a user sits on the chair, the center of gravity of the user is rearward of the springs.

Figure 7:
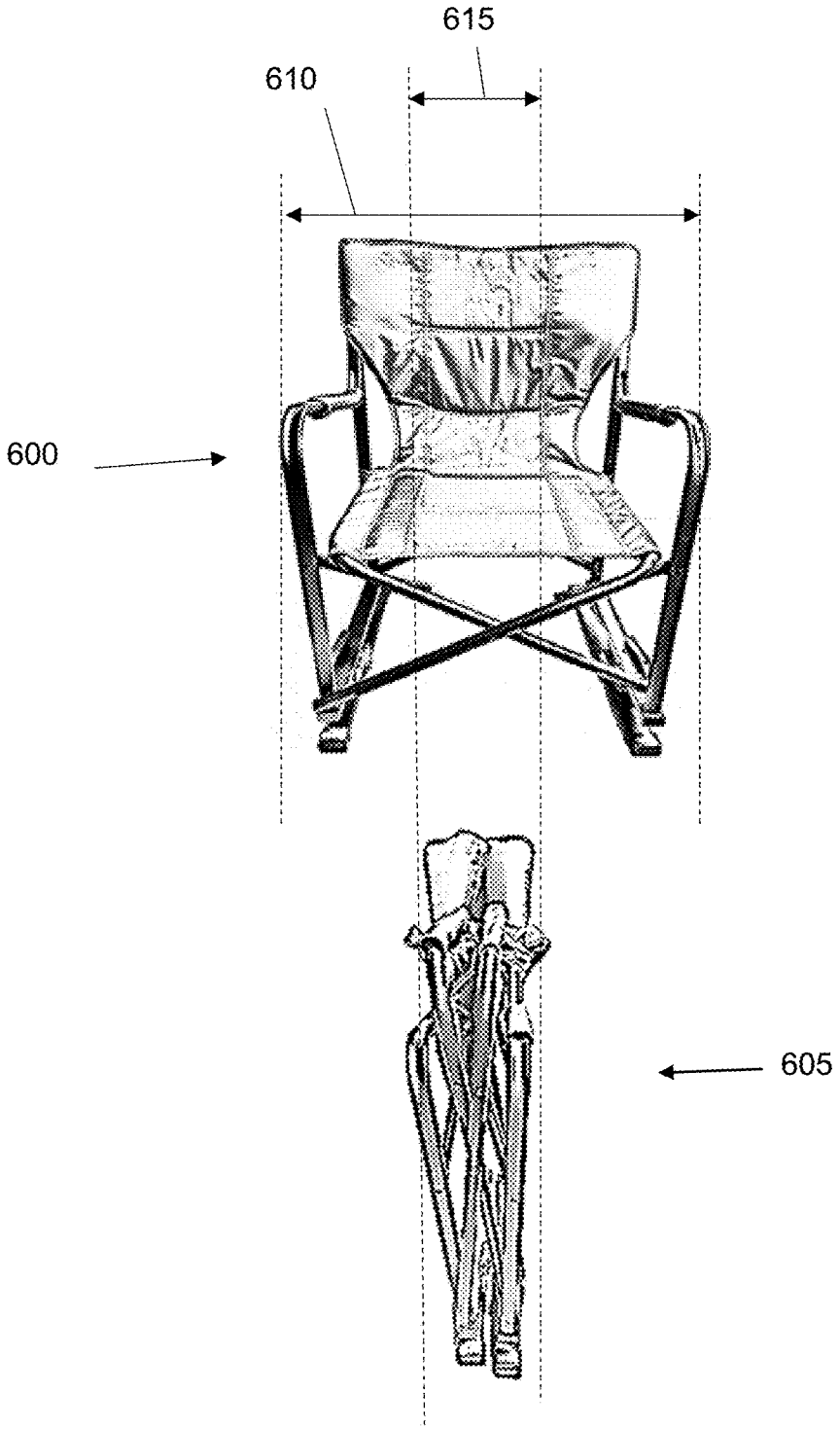
FIG. 7 is a front view of the foldable chair of FIG. 1 in an expanded position and a collapsed position.
Figure 8:
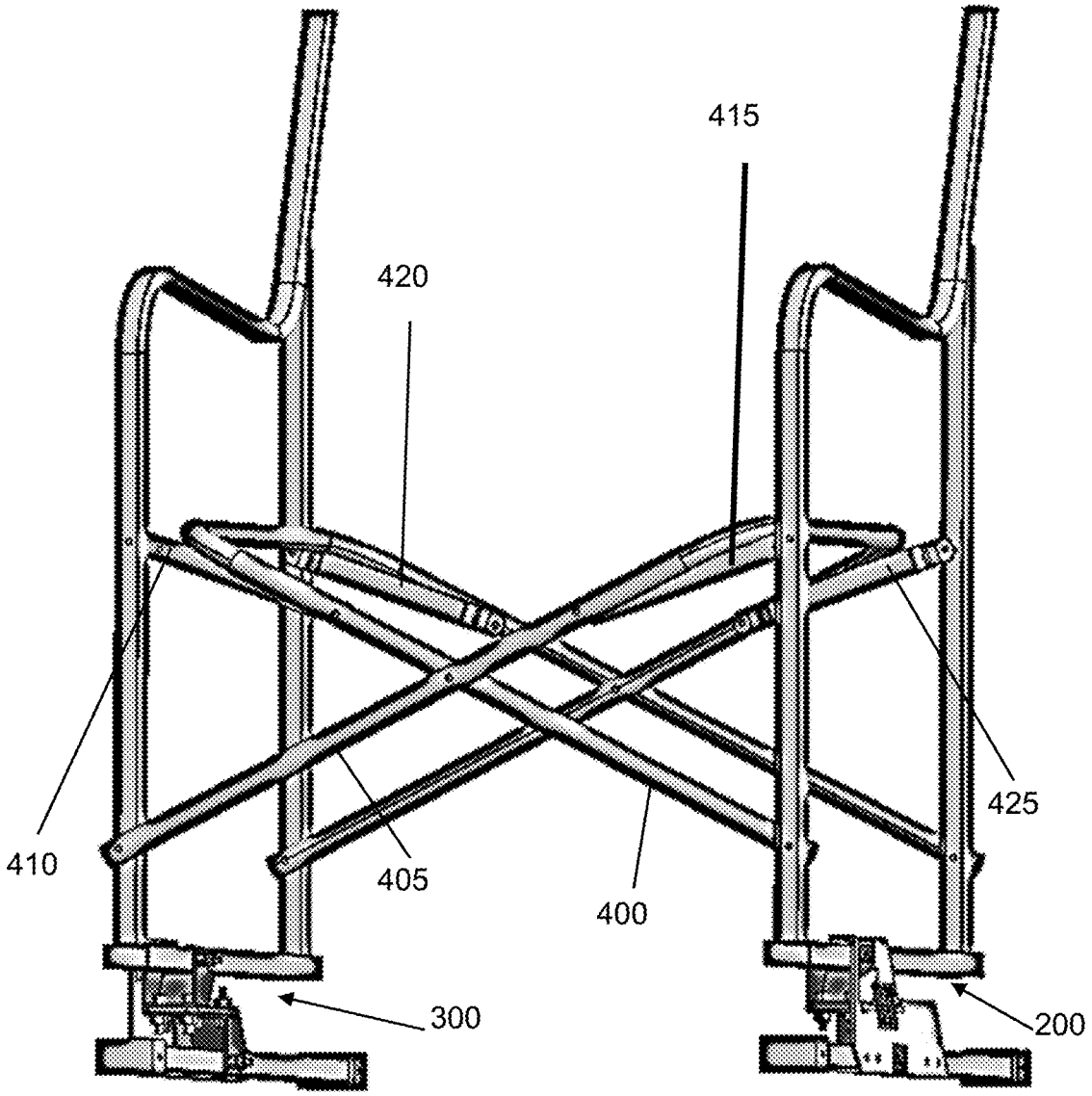
FIG. 8 is another perspective view of the foldable chair of FIG. 1 without a pliant membrane.

As shown in FIGS. 7 and 8, the cross supports 400, 405 are operatively pivotally connected to the left and right frames 200, 300 to enable movement of the left and right frames 200, 300 between an expanded position 600 and a collapsed position 605. In the expanded position 600 the left frame 200 is spaced from the right frame 300 at a first distance 610, and in the collapsed position 605 the left frame 200 is spaced from the right frame 300 at a second distance 615, with the second distance 615 being less than the first distance 610.

The cross supports 400, 405 comprise a pair of cross supports pivotally attached to each other in a crossed manner at forward and rearward portions, and may comprise additional linkages 410, 415, 420 and 425 to facilitate improved movement between the expanded and collapsed positions 600, 605, and/or provide structural integrity to the chair. For example, linkages 410 and 415 may comprise forward linkages connected to forward portions of the frames 200 and 300, and linkages 420 and 425 may comprise rearward linkages connected to rearward portions of the frames 200 and 300. Pivot connections, for example, through a pin, may be provided to rotationally secure the cross supports 400, 405 and/or linkages 410, 415, 420, 425 to each other and/or to the frames 200, 300 to facilitate movement between the expanded and collapsed positions 600, 605.

In operation, the chair 100 is configured such that a user seated on the seating surface 505 with the left and right frames 200, 300 in the expanded position 600 may move back and forth to move the left and right frames 200, 300 relative to the left and right bases 205, 305 between the left and right frame first and second positions as illustrated in FIGS. 5 and 6.

Figure 12:
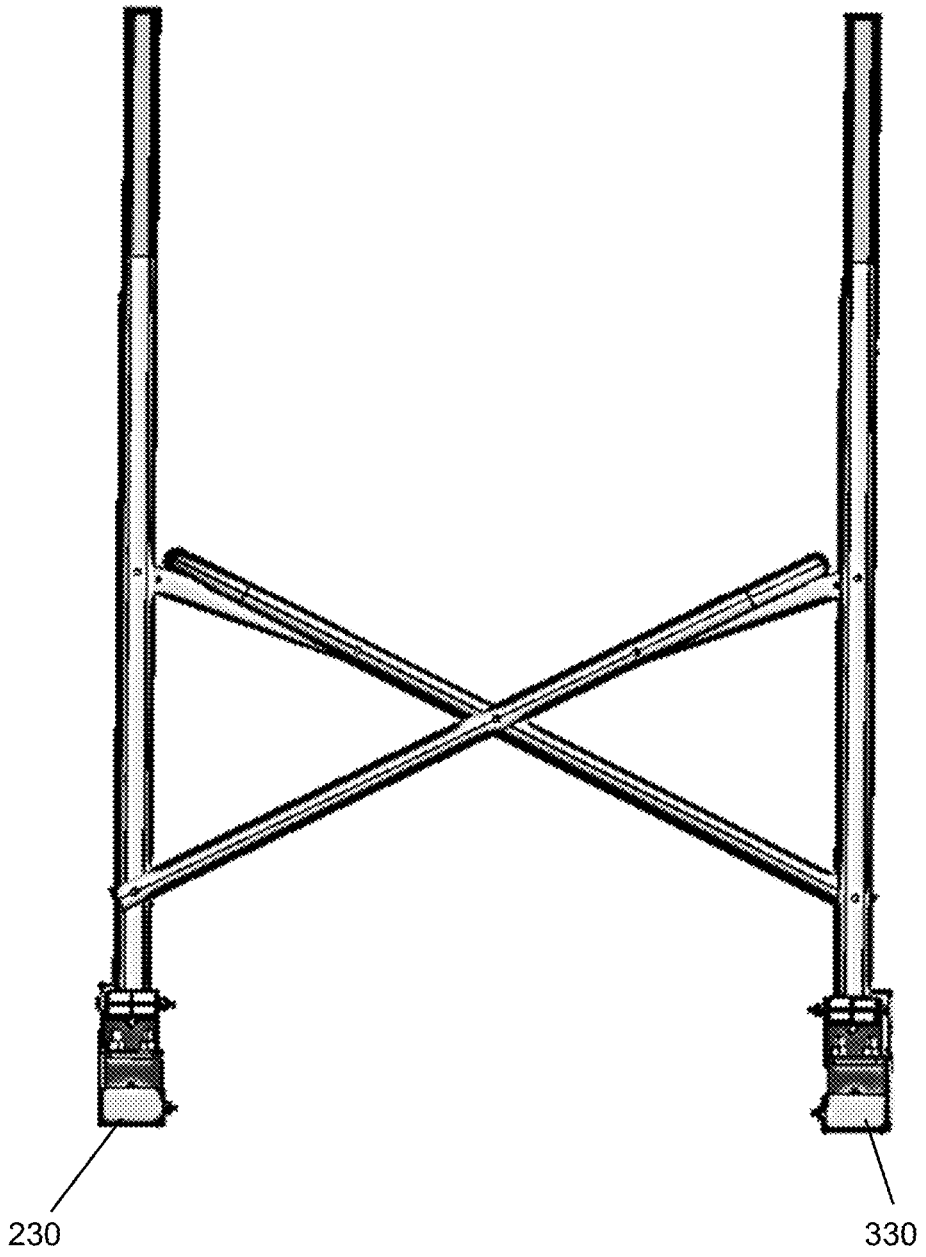
FIG. 12 is a rear view of the foldable chair of FIG. 1 without the pliant membrane.
Figure 13:
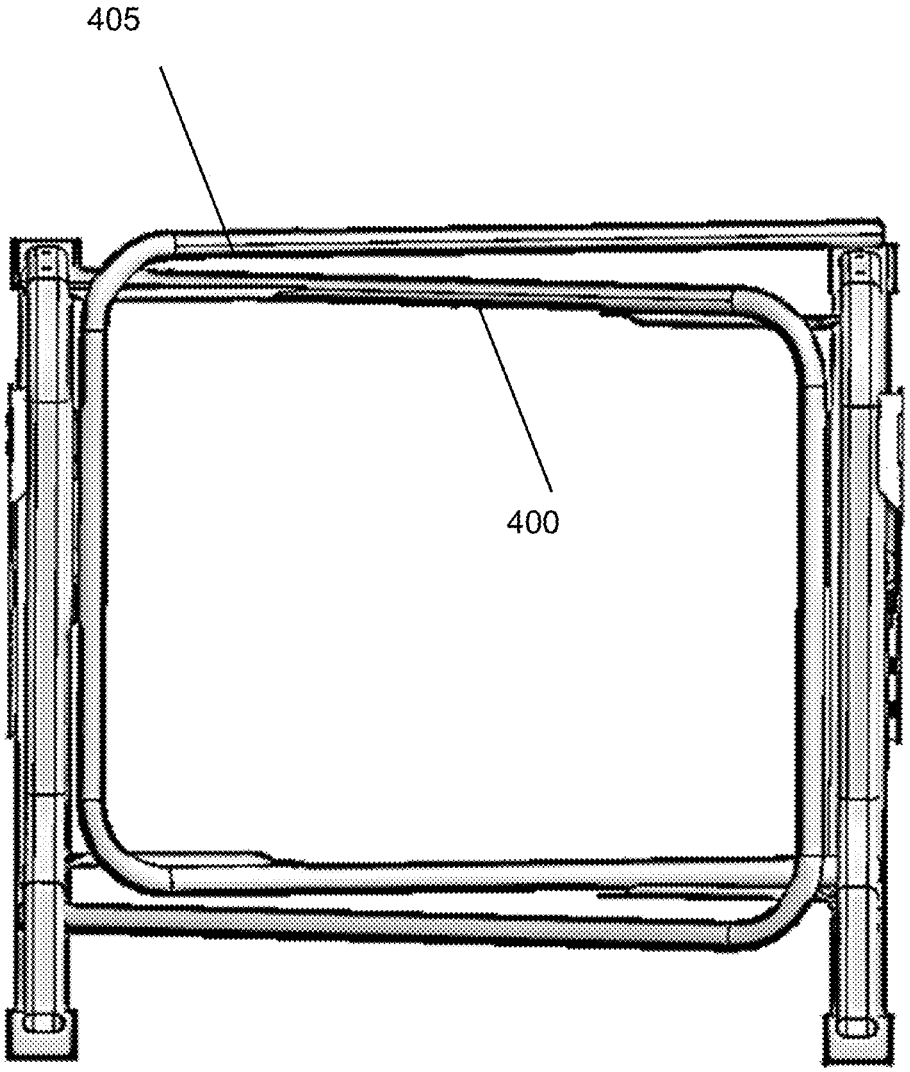
FIG. 13 is a top view of the foldable chair of FIG. 1 without the pliant membrane.
Figure 14:
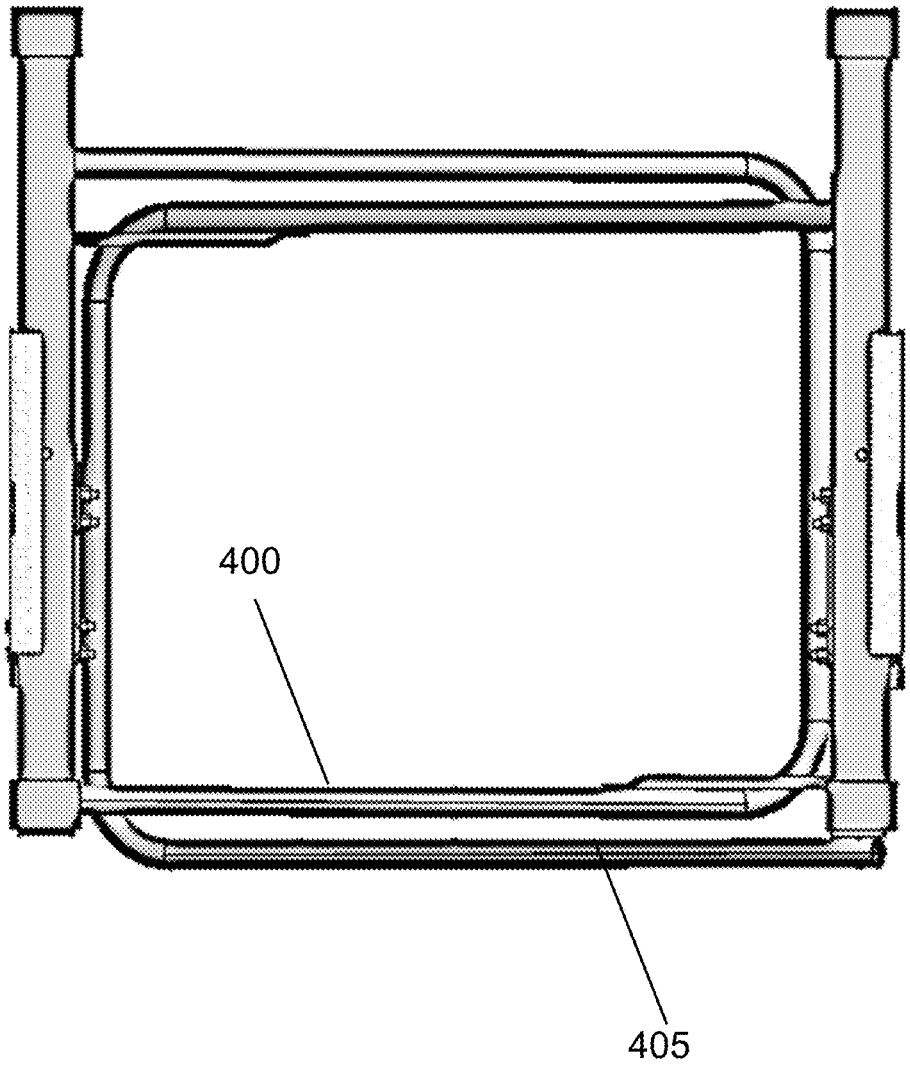
FIG. 14 is a bottom view of the foldable chair of FIG. 1 without the pliant membrane.
Figure 15:
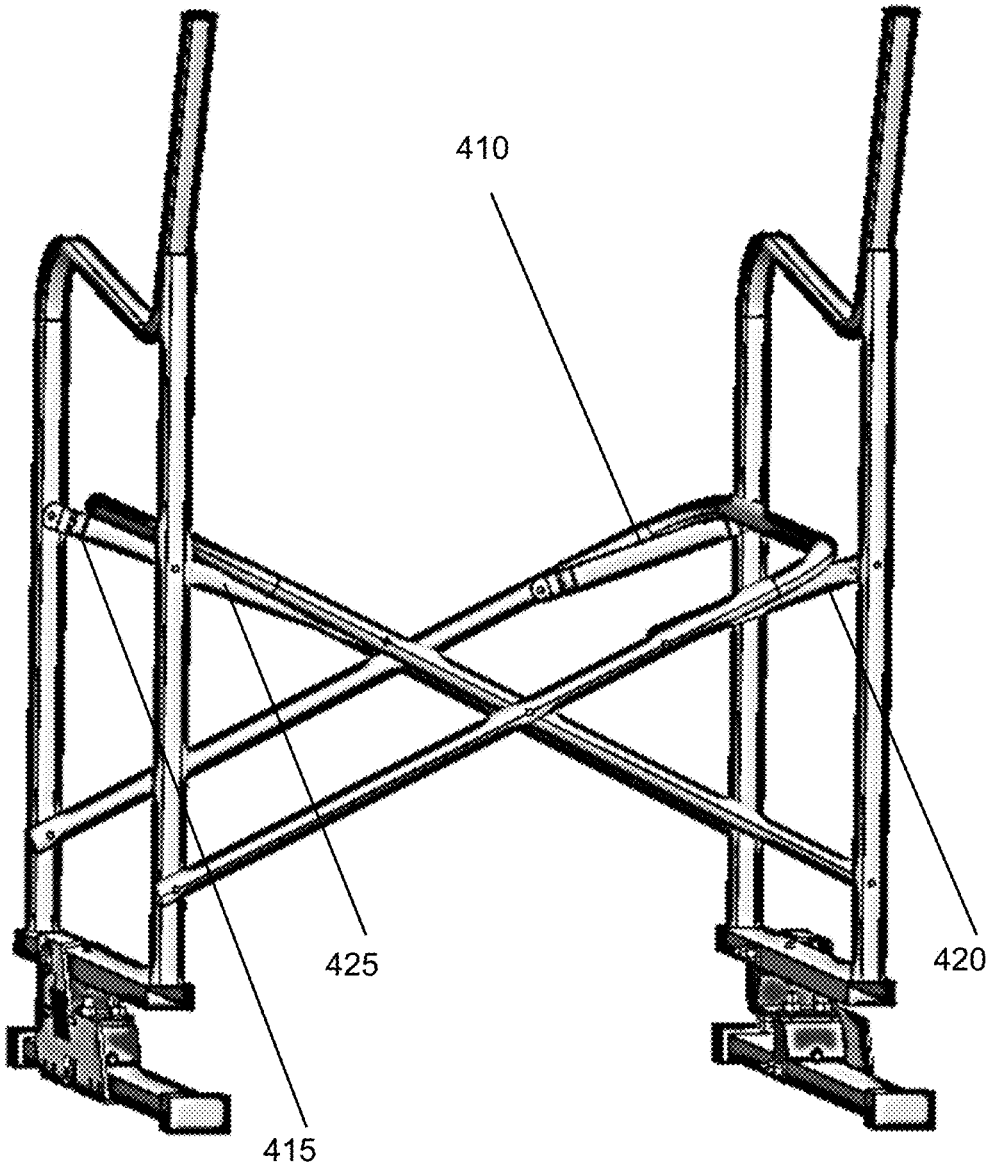
FIG. 15 is a rear perspective view of the foldable chair of FIG. 1 without the pliant membrane.
Figure 16:
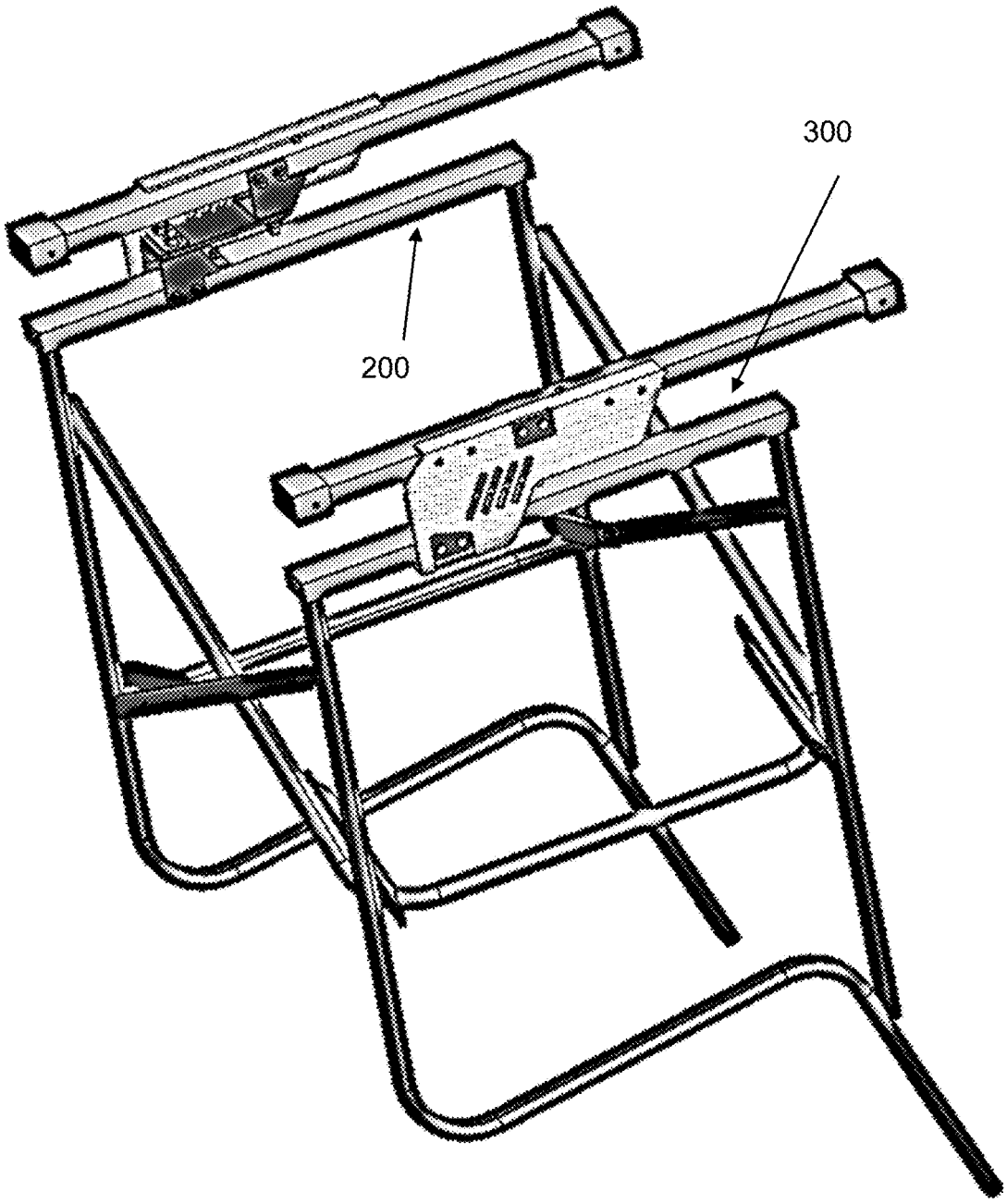
FIG. 16 is a bottom perspective view of the foldable chair of FIG. 1 without the pliant membrane.
Figure 17:
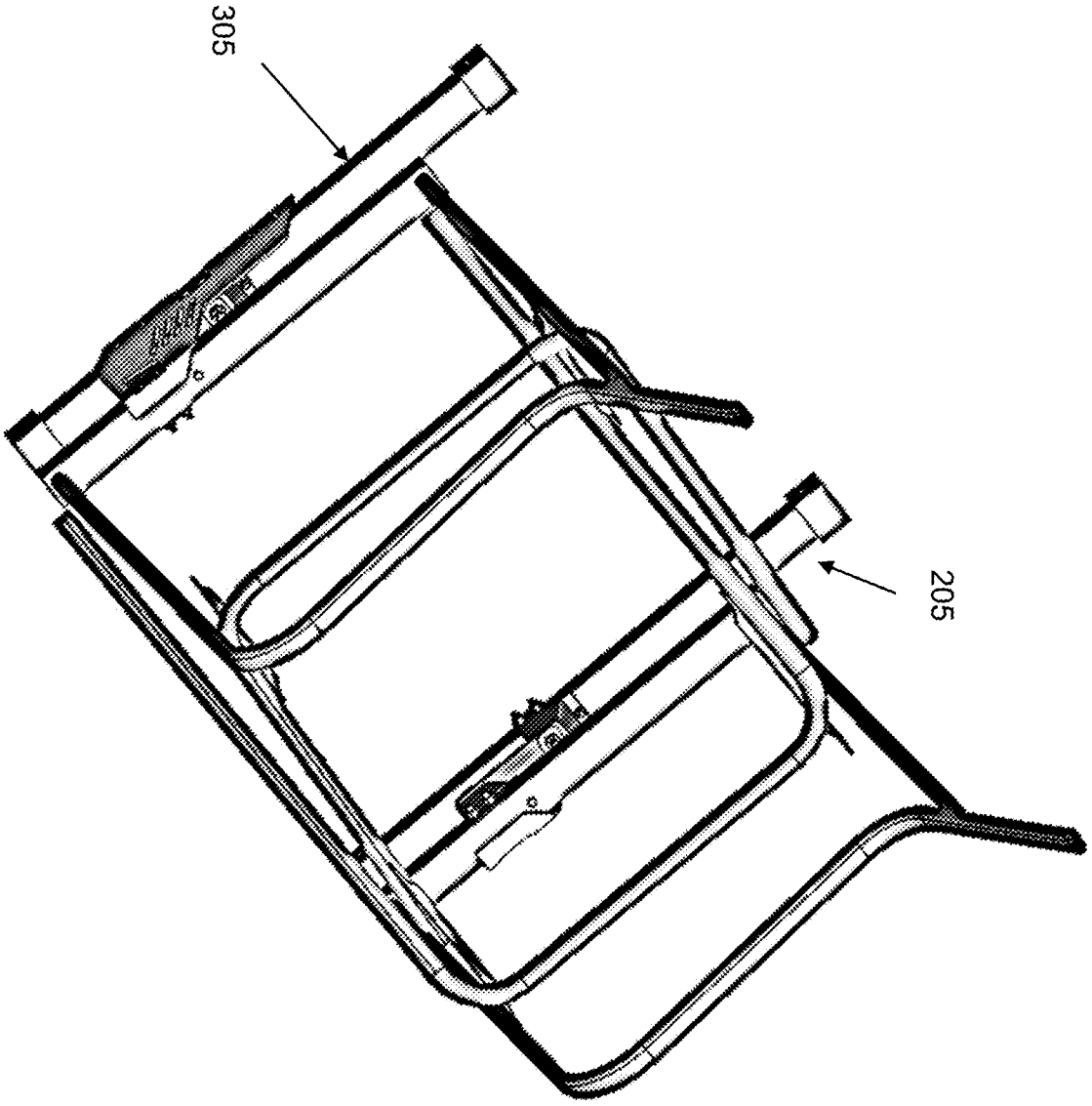
FIG. 17 is a top perspective view of the foldable chair of FIG. 1 without the pliant membrane.
Figure 18:
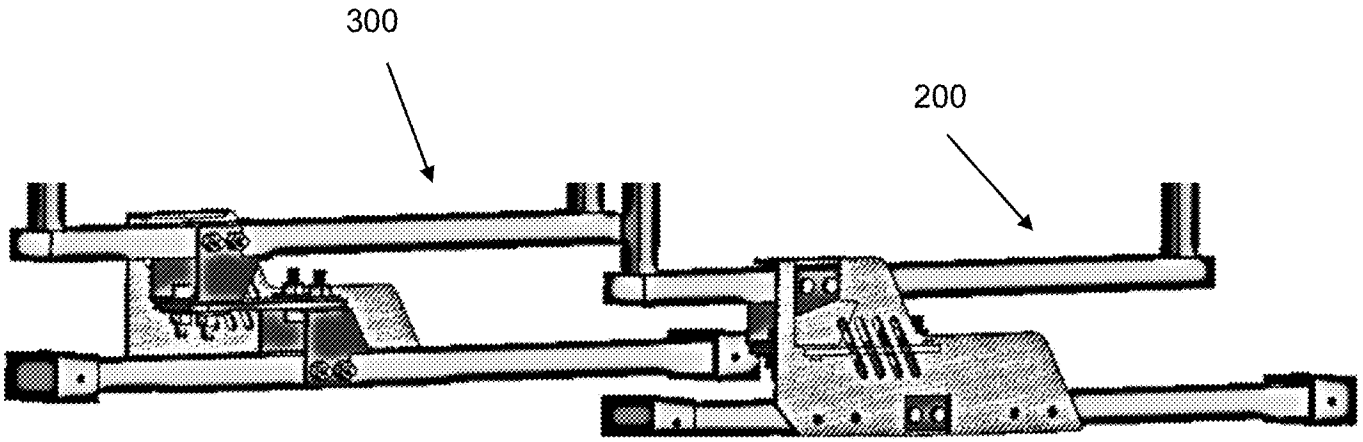
FIG. 18 is an isolated view of frames and bases of the foldable chair of FIG. 1 without the pliant membrane.

FIGS. 9-18 illustrate various other views and perspectives of the chair and/or portions of the chair. FIGS. 9-14 show front, left side, right side, rear, and top and bottom views of the chair, respectively, in the expanded position (front, left side, right side, rear, and top and bottom views of the chair in the collapsed position are not shown). FIG. 9 shows a front view of the chair without the pliant membrane, including cross supports 400 and 405 and ground supports 225 and 325. FIG. 10 shows a left side view of the chair without the pliant membrane, including the base 205, the frame 200, and the ground supports 225 and 230. FIG. 11 shows a right side view of the chair without the pliant membrane, including the base 305, the frame 300, and the ground supports 325 and 330. FIG. 12 shows a rear view of the chair without the pliant membrane, including ground supports 230 and 330. FIG. 13 shows a top view of the chair without the pliant membrane, including cross supports 400 and 405. FIG. 14 shows a bottom view of the chair without the pliant membrane, including cross supports 400 and 405. FIG. 15 shows a rear perspective view of the chair without the pliant membrane, including linkages 410, 415, 420 and 425. FIG. 16 shows a bottom perspective view of the chair without the pliant membrane, including frames 200 and 300. FIG. 17 shows a top perspective view of the chair without the pliant membrane, including bases 205 and 305. FIG. 18 shows a partial enlarged view of the bottom portion of the chair, including frames 200 and 300.

The resilient bending of the springs is based on the thickness, width, length, material, and the forces exerted by the user. The amount of chair bounce (vertical deflection), for example, will depend at least in part on the weight of the user. For example, the chair bounce caused by a heavier user will generally be greater than the chair bounce caused by a lighter user.

The pliant membrane may have sewn portions that form a tunnel/pathway for passage of sections of the cross supports and/or frames.

The components (e.g., frames, bases, springs, supports, etc.) of the chair may be coupled together by fasteners and/or coupling mechanisms such as pins, bolts, latches, hinges and any other similar fasteners and/or coupling mechanisms, and/or may be fixed in a more permanent fashion by way of welding and other similar metal-working techniques. Embodiments that use pins and/or bolts would have corresponding holes to receive the pins and/or bolts, as needed. The frames, base, springs, cross supports, base supports, frame supports, fasteners, etc. may be made of any suitable material such as metal. The pliant membrane may be made of nylon or other similar fabric that is flexible enough to collapse along with the collapsing of the chair, and durable enough to support the weight of an intended user and have long life usage.

In view of the foregoing, it will be seen that the several advantages of the invention are achieved and attained. The embodiments were chosen and described in order to best explain the principles of the disclosure and their practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A foldable chair, comprising:

a left frame;

a right frame;

a plurality of cross supports;

a left base;

a right base;

a left spring;

a right spring; and a pliant membrane;

the left spring comprising a left forward spring portion, a left rearward spring portion and a left intermediate spring portion, the left intermediate spring portion being between the left forward and rearward spring portions and extending from the left forward spring portion to the left rearward spring portion, one of the left forward and rearward spring portions being fixedly secured to the left base and the other of the left forward and rearward spring portions being fixedly secured to the left frame, the left spring being secured to the left base and the left frame in a manner such that the left intermediate spring portion is capable of deflecting relative to the left base and relative to the left frame to enable back and forth movement of the left frame relative to the left base between a left frame first position and a left frame second position;

the right spring comprising a right forward spring portion, a right rearward spring portion and a right intermediate spring portion, the right intermediate spring portion being between the right forward and rearward spring portions and extending from the right forward spring portion to the right rearward spring portion, one of the right forward and rearward spring portions being fixedly secured to the right base and the other of the right forward and rearward spring portions being fixedly secured to the right frame, the right spring being secured to the right base and the right frame in a manner such that the right intermediate spring portion is capable of deflecting relative to the right base and relative to the right frame to enable back and forth movement of the right frame relative to the right base between a right frame first position and a right frame second position;

the plurality of cross supports being operatively pivotally connected to the left and right frames to enable movement of the left and right frames between an expanded position and a collapsed position, wherein in the expanded position the left frame is spaced from the right frame at a first distance, and in the collapsed position the left frame is spaced from the right frame at a second distance, the second distance being less than the first distance;

the pliant membrane being operatively connected to portions of the left and right frames such that in the expanded position the pliant membrane is configured to provide a seating surface for supporting a user;

the chair being configured to be positioned on a support surface such that a user seated on the seating surface with the left and right frames in the expanded position may move back and forth to move the left and right frames relative to the left and right bases between the left and right frame first and second positions, the chair being devoid of wheels;

wherein the left base comprises a left base support, the left frame comprises a left frame support, the right base comprises a right base support, and the right frame comprises a right frame support; and wherein the left spring is fixedly secured to the left base support and the left frame support, and the right spring is fixedly secured to right base support and the right frame support.

2. The foldable chair of claim 1, wherein the plurality of cross supports comprise a pair of cross supports pivotally attached to each other in a crossed manner.

3. The foldable chair of claim 2, wherein the plurality of cross supports further comprises a plurality of linkages.

4. The foldable chair of claim 1, wherein the left spring constitutes a plate or a bar, and the right spring constitutes a plate or bar.

5. The foldable chair of claim 1, wherein:

the left base comprises a left front ground support and a left rear ground support;

the right base comprises a right front ground support and a right rear ground support.

6. The foldable chair of claim 1, wherein:

the left spring is fixedly secured to a forward portion of the left base and fixedly secured to a forward portion of the left frame; and the right spring is fixedly secured to a forward portion of the right base and fixedly secured to a forward portion of the right frame.

7. A foldable chair, comprising:

a left frame;

a right frame;

a plurality of cross supports;

a left base;

a right base;

a left spring;

a right spring; and a pliant membrane;

the left spring extending from the left base to the left frame, the left spring being configured to deflect relative to the left base and relative to the left frame to enable back and forth movement of the left frame relative to the left base between a left frame first position and a left frame second position;

the right spring extending from the right base to the right frame, the right spring being configured to deflect relative to the right base and relative to the right frame to enable back and forth movement of the right frame relative to the right base between a right frame first position and a right frame second position;

the plurality of cross supports being operatively pivotally connected to the left and right frames to enable movement of the left and right frames between an expanded position and a collapsed position, wherein in the expanded position the left frame is spaced from the right frame at a first distance, and in the collapsed position the left frame is spaced from the right frame at a second distance, the second distance being less than the first distance;

the pliant membrane being operatively connected to portions of the left and right frames such that in the expanded position the pliant membrane is configured to provide a seating surface for supporting a user;

the chair being configured such that with the left and right frames in the expanded position and with a user seated on the seating surface the entire weight of the left and right frames and the pliant membrane is transferred through the left and right springs to the left and right bases;

the chair being configured to be positioned on a support surface such that a user seated on the seating surface with the left and right frames in the expanded position may move back and forth to move the left and right frames relative to the left and right bases between the left and right frame first and second positions, the chair being devoid of any wheels that enable movement of the chair with respect to the support surface when the user is seated on the seating surface;

wherein in operation, the chair is positioned on the support surface with the left and right frames in the expanded position, the user is seated on the seating surface, the chair is in a position between the left and right frame first and second positions, no portion of the left frame is in direct contact with the left base and/or the support surface, and no portion of the right frame is in direct contact with the right base and/or the support surface;

wherein the left base comprises a left base support, the left frame comprises a left frame support, the right base comprises a right base support, and the right frame comprises a right frame support; and wherein the left spring is fixedly secured to the left base support and the left frame support, and the right spring is fixedly secured to right base support and the right frame support.

8. The foldable chair of claim 7, wherein when the chair is in the position between the left and right frame first and second positions, no portion of the left frame is in contact with the left base other than via the left spring, and no portion of the right frame is in contact with the right base other than via the right spring.

9. The foldable chair of claim 7, wherein:

the left base comprises a left rear ground support; and the right base comprises a right rear ground support.

10. The foldable chair of claim 7, wherein:

the left spring is between the left frame and the left base; and the right spring is between the right frame and the right base.

11. The foldable chair of claim 7, wherein:

the left spring and the left base are separate members connected together; and the right spring and the right base are separate members connected together.

12. The foldable chair of claim 9, wherein the left spring constitutes a plate or a bar, and the right spring constitutes a plate or bar.

13. The foldable chair of claim 9, wherein:

the left base comprises a left front ground support and a left rear ground support;

the right base comprises a right front ground support and a right rear ground support.

14. The foldable chair of claim 9, wherein:

the left spring is fixedly secured to a forward portion of the left base and fixedly secured to a forward portion of the left frame; and the right spring is fixedly secured to a forward portion of the right base and fixedly secured to a forward portion of the right frame.

15. The foldable chair of claim 9, wherein the plurality of cross supports comprise a pair of cross supports pivotally attached to each other in a crossed manner.

16. The foldable chair of claim 15, wherein the plurality of cross supports further comprises a plurality of linkages.

* * * * *